US006735973B2

(12) United States Patent
Lee

(10) Patent No.: US 6,735,973 B2
(45) Date of Patent: May 18, 2004

(54) MULTI-TYPE AIR CONDITIONER

(75) Inventor: Chang Seon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/459,423

(22) Filed: Jun. 12, 2003

(65) Prior Publication Data

US 2003/0230107 A1 Dec. 18, 2003

(30) Foreign Application Priority Data

Jun. 12, 2002 (KR) ..... P10-2002-0032898

(51) Int. Cl.[7] ..... F25B 13/00; F25B 1/00
(52) U.S. Cl. ..... 62/324.6; 62/510
(58) Field of Search ..... 62/324.6, 504, 62/510, 335, 498, 513

(56) References Cited

U.S. PATENT DOCUMENTS 5,309,733 A * 5/1994 Hayashida et al. ..... 62/278
2003/0230105 A1 * 12/2003 Lee ..... 62/324.6

FOREIGN PATENT DOCUMENTS

JP 03011276 A * 1/1991 ..... F25B/29/00

* cited by examiner

*Primary Examiner*—Chen Wen Jiang
(74) *Attorney, Agent, or Firm*—Greenblum & Bernstein, P.L.C.

(57) ABSTRACT

Multi-type air conditioner including a plurality of distributors each including a gas-liquid separator for separating refrigerant from the outdoor unit into gas refrigerant and liquid refrigerant, and distributor pipelines for guiding the gas or liquid refrigerant separated at the gas-liquid separator to the indoor units, and guiding the refrigerant passed through the indoor unit to the outdoor unit again, and an equalizing pipeline part for connecting the distributors for equal supply of refrigerant, thereby installing the indoor unit easily, and improving an air conditioning efficiency by supplying the refrigerant, equally.

20 Claims, 8 Drawing Sheets

MULTI-TYPE AIR CONDITIONER

This application claims the benefit of the Korean Application No. P2002-32898 filed on Jun. 12, 2002, which is hereby incorporated by reference.

BACKGROUND OF THE INVENTION

1. Field of the Invention

The present invention relates to a multi-type air conditioner.

2. Background of the Related Art

In general, the air conditioner is an appliance for cooling or heating a room space, such as a residential space, a restaurant, and an office. Recently, there have been ceaseless developments of multi-type air conditioner for more efficient cooling or heating of a room space partitioned into a plurality of rooms.

The multi-type air conditioner is provided with one outdoor unit and multiple indoor units each installed in each room and connected to the one outdoor unit. The multi-type air conditioner operative either in a cooling or heating mode for cooling or heating a room.

However, of the plurality of rooms, even in a case when some of rooms require heating while other rooms require cooling, since the multi-type air conditioner is operative in the cooling mode or heating mode uniformly, the multi-type air conditioner has a limit in dealing with such a requirement, properly.

For an example, there are rooms in a building, of which temperature differ from other room depending on locations of the rooms or time in a day. That is, while rooms in a north side part of the building require heating, rooms in a south side part of the building require cooling, to which requirements the related art multi-type air conditioner operative only in one mode can not but fail to deal with, properly. Moreover, in a case the building has a computer room, which requires cooling for coping with heat generation of the computer, not only in summer, but also in winder, the related art multi-type air conditioner fails to deal with such a requirement, properly.

At the end, above requirements calls for a multi-type air conditioner which can air condition the rooms simultaneously and individually. That is, development of a multi-type air conditioner of simultaneous cooling/heating type is required, so that the indoor unit in a room which requires heating is operated in a heating mode, and, at the same time with this, the indoor unit in a room which requires cooling is operated in a cooling mode.

SUMMARY OF THE INVENTION

Accordingly, the present invention is directed to a multi-type air conditioner that substantially obviates one or more of the problems due to limitations and disadvantages of the related art.

An object of the present invention is to provide a multi-type air conditioner which can carry out heating and cooling at the same time.

Another object of the present invention is to provide a multi-type air conditioner which has a plurality of distributors for easy installation of indoor units, reduction of lengths of piping connecting the distributors to the indoor units, simplifying pipe connection between the distributors and the indoor units for easy piping work of the indoor units and better outer appearance.

Further object of the present invention is to provide a multi-type air conditioner, in which refrigerant in the distributors is designed to move to each other for improvement of an air conditioning efficiency.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-type air conditioner includes an outdoor unit installed to an outside of a room, including a compressor and a outdoor heat exchanger, outdoor pipelines connected to the compressor and the outdoor heat exchanger for forming flow paths, and a plurality of outdoor valves mounted on the outdoor pipelines for controlling refrigerant flow, a plurality of indoor units installed in rooms respectively each including an indoor heat exchanger and an electronic expansion valve, and a plurality of distributors each including a gas-liquid separator for separating refrigerant from the outdoor unit into gas refrigerant and liquid refrigerant, and distributor pipelines for guiding the gas or liquid refrigerant separated at the gas-liquid separator to the indoor units, and guiding the refrigerant passed through the indoor unit to the outdoor unit again.

The outdoor pipelines includes a pipeline connecting an outlet of the compressor and an inlet of the gas-liquid separator, to form a refrigerant flow passage from the compressor to the gas-liquid separator, and a pipeline connecting a distributor pipeline and the inlet of the compressor to form a refrigerant flow passage from the distributor to the compressor.

The outdoor valves include a first four way valve mounted on an outlet side of the compressor for making the outdoor pipelines in communication with each other selectively depending on operation conditions, to fix a flow path of the refrigerant to/from the compressor, and a second four way valve mounted on a gas-liquid separator side to be operative in correspondence to the first four way valve, for making the outdoor pipelines in communication with each other selectively depending on operation conditions, to fix a flow path of the refrigerant to the gas-liquid separator or from the distributor pipeline.

The outdoor pipeline connected between the second four way valve and the gas-liquid separator is a high pressure section only a high pressure state of refrigerant flows therethrough, and the outdoor pipeline connected between the distributor pipeline and the second four way valve is a low pressure section only a low pressure state of refrigerant flows therethrough.

The high pressure section includes high pressure branch pipelines branched to the gas-liquid separators, and the low pressure section includes low pressure branch pipelines branched to the distributor pipelines of the distributors.

Preferably, the high pressure section has a pipe diameter smaller than the low pressure section for prevention of non-uniform flow rates caused by a specific volume difference between high pressure refrigerant and low pressure refrigerant.

The distributor pipelines includes a liquid refrigerant pipeline for guiding liquid refrigerant separated at the gas-liquid separators, a liquid refrigerant branch pipeline branched from the liquid refrigerant pipeline to the electronic expansion valves in the indoor units, a gas refrigerant pipeline for guiding gas refrigerant separated at the gas-liquid separators, a gas refrigerant branch pipeline branched from the gas refrigerant pipeline to the indoor heat exchangers in the indoor unit, and a heating mode return branch pipeline branched from a fore end of the liquid refrigerant pipeline for returning refrigerant heat exchanged in selected indoor units depending on operation conditions, a cooling mode return branch pipeline branched from each of the gas refrigerant branch pipelines for returning refrigerant heat exchanged at selected indoor units depending on operation conditions, and a return pipeline for joining the heating mode return branch pipeline and the cooling mode return branch pipeline into one pipeline and connected to the indoor unit pipelines.

Preferably, the gas refrigerant pipeline and the liquid refrigerant pipeline are arranged in parallel for an efficiency of piping. The outdoor pipelines includes a pipeline connecting an outlet of the compressor and an inlet of the gas-liquid separator, to form a refrigerant flow passage from the compressor to the gas-liquid separator, and a pipeline connecting the return pipeline and the inlet of the compressor to form a refrigerant flow passage from the distributor to the compressor.

The outdoor valves include a first four way valve mounted on an outlet side of the compressor for making the outdoor pipelines in communication with each other selectively, to fix a flow path of the refrigerant to/from the compressor, and a second four way valve mounted on a gas-liquid separator side to be operative in correspondence to the first four way valve, for making the outdoor pipelines in communication with each other selectively, to fix a flow path of the refrigerant to/from the return pipeline.

The outdoor pipeline connected between the second four way valve and the gas-liquid separator is a high pressure section only a high pressure state of refrigerant flows therethrough, and the outdoor pipeline connected between the distributor pipeline and the second four way valve is a low pressure section only a low pressure state of refrigerant flows therethrough.

The high pressure section includes high pressure branch pipelines branched to the gas-liquid separators, and the low pressure section includes low pressure branch pipelines branched to the return pipelines of the distributors.

The high pressure section has a pipe diameter smaller than the low pressure section for prevention of non-uniform flow rates caused by a specific volume difference between high pressure refrigerant and low pressure refrigerant.

The distributor includes a valve part for controlling refrigerant flow in the distributor pipelines. The valve part includes a first electronic expansion valve mounted between the gas-liquid separator and the heating mode return branch pipeline for controlling an opening thereof depending on an operation condition, a second electronic expansion valve mounted on the heating mode return branch pipeline for controlling an opening thereof depending on an operation condition, and a plurality of control valves mounted on the gas refrigerant branch pipelines, liquid refrigerant branch pipelines, and cooling mode return branch pipeline.

In this instance, it is preferable that the control valve is two way valve turned on/off selectively depending on operation condition.

The distributor pipeline further includes an equalizing pipeline part connected between the distributors for equal supply of refrigerant to the distributors. The equalizing pipeline part includes a gas refrigerant equalizing pipeline for equal supply of gas refrigerant introduced into the gas-liquid separators to the distributors, and liquid refrigerant equalizing pipeline for equal supply of liquid refrigerant introduced into the gas-liquid separators to the distributors.

The gas refrigerant equalizing pipeline is connected to the gas refrigerant pipeline of the distributors, and the liquid refrigerant equalizing pipeline is connected to the liquid refrigerant pipeline of the distributors. The liquid refrigerant equalizing pipeline has a pipe diameter smaller than the gas refrigerant equalizing pipeline for prevention of non-uniform flow rates caused by a specific volume difference between high pressure refrigerant and low pressure refrigerant.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

Figure 5A:
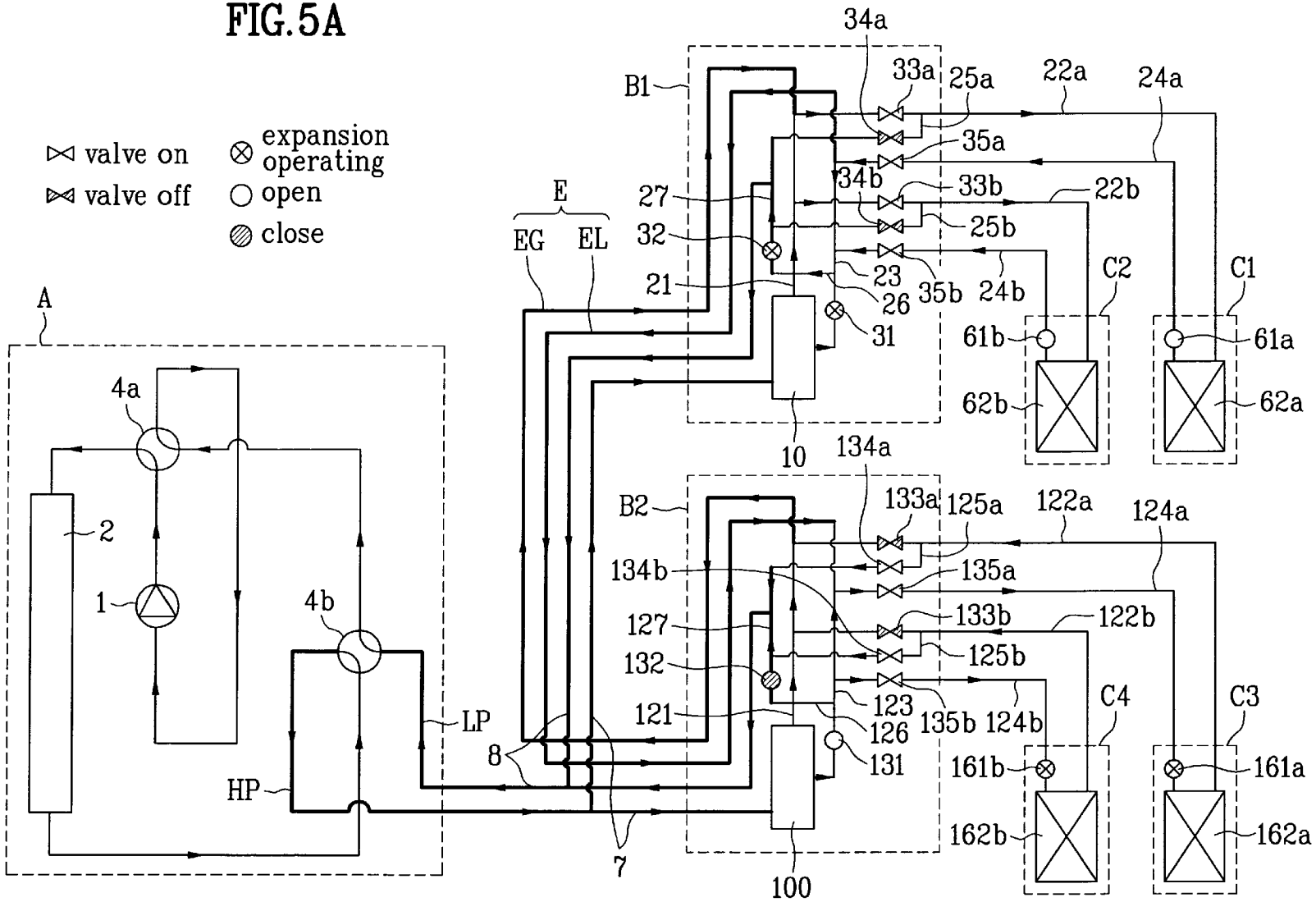
Figure 5B:
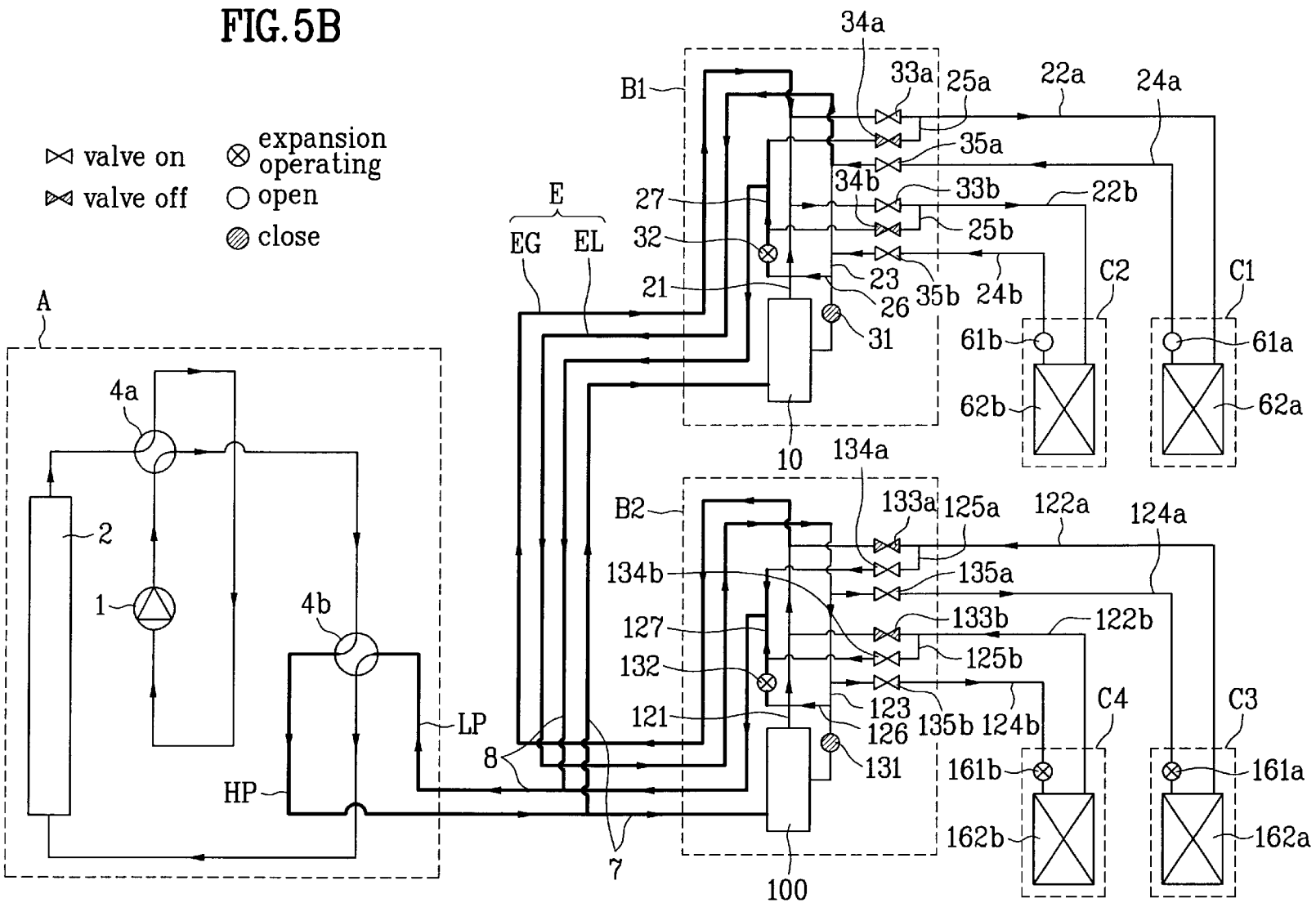

FIG. 5A illustrates a system showing an operation state of a multi-type air conditioner in accordance with a preferred embodiment of the present invention when the multi-type air conditioner is in a cooling mode or major cooling mode; and FIG. 5B illustrates a system showing an operation state of a multi-type air conditioner in accordance with a preferred embodiment of the present invention when the multi-type air conditioner is in a heating mode or major heating mode.

DETAILED DESCRIPTION OF THE PREFERRED EMBODIMENTS

Reference will now be made in detail to the preferred embodiments of the present invention, examples of which are illustrated in the accompanying drawings. In describing the present invention, same parts will be given the same names and reference symbols, and repetitive description of which will be omitted.

In describing embodiments of the present invention, it is assumed that a multi-type air conditioner includes two distributors and four indoor units. Of course, numbers of the distributors and the indoor units may vary with operational environment and conditions.

Figure 1:
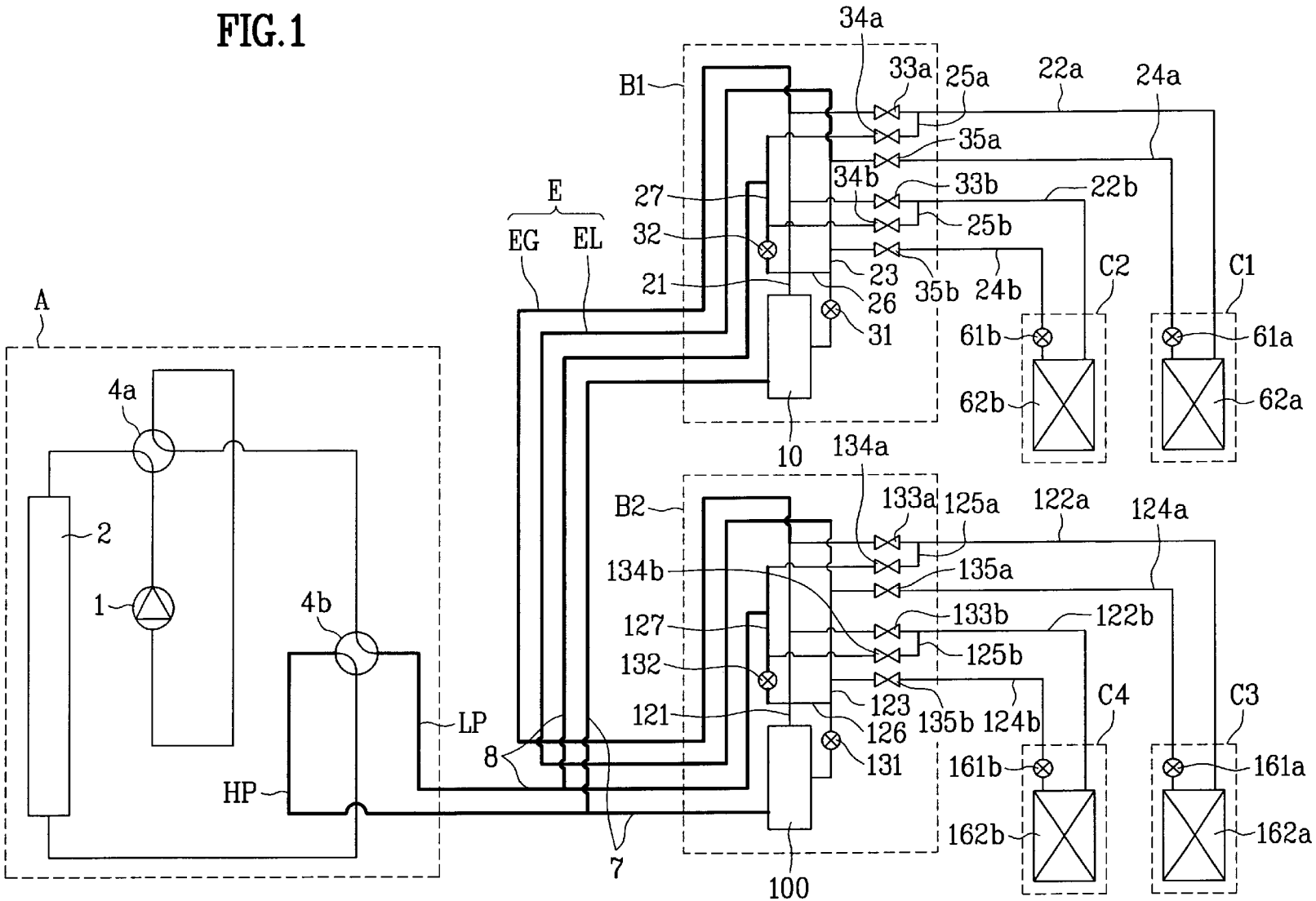
FIG. 1 illustrates a system of a multi-type air conditioner in accordance with a preferred embodiment of the present invention.

Referring to FIG. 1, the multi-type air conditioner of the present invention includes an outdoor unit 'A', distributors 'B1', and 'B2', and indoor units 'C1', 'C2', 'C3', and 'C4'.

The outdoor unit 'A' includes a compressor 1 and an outdoor heat exchanger 2, both installed outside of a room. The compressor 1 and the outdoor heat exchanger 2 are connected to each other with outdoor unit pipelines. There are a plurality of valves 4*a* and 4*b* on the outdoor unit pipelines for controlling refrigerant flow.

The indoor units 'C1', 'C2', 'C3', and 'C4' in the rooms include indoor heat exchangers 62*a*, 62*b*, 162*a*, and 162*b*, and electronic expansion valves 61*a*, 61*b*, 161*a*, and 161*b*, respectively.

The distributors B1 and B2 includes gas-liquid separators 10, and 100 for separating refrigerant introduced from the outdoor unit 'A' into gas refrigerant and liquid refrigerant, and distributor pipelines for guiding gas and liquid refrigerant. The distributor pipelines guide the refrigerant separated at the gas-liquid separators 10 and 100 to the indoor units 'C1', 'C2', 'C3', and 'C4', and the refrigerant passed through the indoor units 'C1', 'C2', 'C3', and 'C4' to the outdoor unit 'A'.

The outdoor unit 'A', the distributors B1, and B2, and the indoor units C1, C2, C3, and C4 will be described in more detail.

The outdoor unit 'A' includes a pipeline connecting an outlet of the compressor 1 and inlets of the gas-liquid separators 10 and 100, to form a refrigerant flow passage from the compressor 1 to the gas-liquid separators 10 and 100, and a pipeline connecting a pipeline of the distributors B1 and B2 and the inlet of the compressor 1, to form a refrigerant flow passage from the distributors B1 and B2 to the compressor 1.

In the outdoor unit, there are a first four way valve 4*a* and a second four way valve 4*b* for controlling flow of the refrigerant. The first four way valve 4*a* makes the outdoor unit pipelines to be in communication with each other selectively on an outlet side of the compressor 1 for fixing refrigerant flow paths to/from the compressor 1. The second four way valve 4*b* is operated in correspondence to the first four way valve 4*a* to make the outdoor unit connection pipelines to be in communication with each other selectively on a side of the gas-liquid separators 10 and 100, for fixing refrigerant flow paths to/from the gas-liquid separator 10 and 100.

In more detail, the first four way valve 4*a* and the second four way valve 4*b* are connected to four pipelines in the outdoor unit. That is, the first four way valve 4*a* is connected to pipelines each connecting the outlet of the compressor and the first four way valve 4*a*, the first four way valve 4*a* and the outdoor heat exchanger 2, the first four way valve 4*a* and the inlet of the compressor 1, and the first four way valve 4*a* and the second four way valve 4*b*.

The second four way valve 4*b* is connected to four pipelines each connecting the outdoor heat exchanger 2 and the second four way valve 4*b*, the second four way valve 4*b* and the gas-liquid separator 10 and 100, a distributor pipeline and the second four way valve 4*b*, and the second four way valve 4*b* and the first four way valve 4*a*.

The first and second four way valves 4*a* and 4*b* connected to the pipelines thus connect respective pipelines selectively depending on operation condition to fix refrigerant flow paths.

For an example, when the multi-type air conditioner is operated in a cooling mode, the refrigerant from the compressor 1 to the gas-liquid separators 10 and 100 flows through pipelines connecting the outlet of the compressor 1 and the first four way valve 4*a*, the first four way valve 4*a* and the outdoor heat exchanger 2, the outdoor heat exchanger 2 and the second four way valve 4*b*,and the second four way valve 4*b* and the gas-liquid separator 10 and 100. The refrigerant from the distributor pipeline to the compressor 1 flows through pipelines connecting the distributor pipeline and the second four way valve 4*b*, the second four way valve 4*b* and the first four way valve 4*a*, and the first four way valve 4*a* and the inlet of the compressor 1.

When the multi-type air conditioner is operated in a heating mode, a flow path of the refrigerant is changed. The change of refrigerant flow path will be described in detail, later.

In the meantime, it is preferable that a pipeline of the outdoor unit connecting the second four way valve 4*b* and the gas-liquid separator 10 and 100 is designated as a high pressure section HP in which high pressure refrigerant only flows by controlling the first and second four way valves 4*a* and 4*b*. It is also preferable that a pipeline of the outdoor unit connecting the second four way valve 4*b* and the distributors is designated as a low pressure section LP in which low pressure refrigerant only flows.

The high pressure section HP includes high pressure branch pipelines 7 branched to the gas-liquid separators 10 and 100, and the low pressure section LP includes low pressure branch pipelines 8 branched to the distributor pipelines.

It is preferable that the high pressure section HP has a pipe diameter smaller than the low pressure section LP, for preventing non-uniform flow rate of the refrigerant caused by a difference of specific volumes of the high pressure refrigerant and the low pressure refrigerant. That is, because the high pressure refrigerant has a specific volume smaller than the low pressure refrigerant, a flow rate of the high pressure refrigerant is greater than the low pressure refrigerant if the pipe diameters are the same. Therefore, if the pipe diameter of the high pressure section HP is made smaller than the diameter of the low pressure section LP, to make refrigerant flow rates in the respective section equal, an air conditioning efficiency of the air conditioner will be improved.

Next, with regard to the distributors 'B1' and 'B2', the distributors B1 and B2 are provided between the outdoor unit 'A' and the plurality of indoor units C1, C2, C3, and C4. It is preferable that at least two distributors B1 and B2 are provided, for easy guidance of the refrigerant to the plurality of indoor units C1, C2, C3, and C4 depending on operation conditions, and having a freedom of installation according to installation positions of the indoor units C1, C2, C3, and C4. Thus, the distributor B1 and B2 include the gas-liquid separators 10 and 100, and the distributor pipelines.

The distributor pipelines includes liquid refrigerant pipelines 23 and 123, liquid refrigerant branch pipelines 24*a*, 24*b*, 124*a* and 124*b*, gas refrigerant pipelines 21 and 121, gas refrigerant branch pipelines 22*a*, 22*b*, 122*a*, and 122*b*, heating mode return branch pipelines 26 and 126, cooling mode return branch pipelines 25*a*, 25*b*, 125*a*,and 125*b*, and return pipelines 27 and 127.

The liquid refrigerant pipelines 23 and 123 guide liquid refrigerant separated at the gas-liquid separator 10 and 100, and the liquid refrigerant branch pipelines 24*a*, 24*b*, 124*a* and 124*b* are branched from the liquid refrigerant pipelines 23 and 123 and connected to the electronic expansion valves 61*a*, 61*b*, 161*a*, and 161*b* in the indoor units and the indoor unit heat exchangers 62*a*, 62*b*, 162*a*, and 162*b*. The gas refrigerant pipelines 21 and 121 guide gas refrigerant separated at the gas-liquid separators 10 and 100, and the gas refrigerant branch pipelines 22*a*, 22*b*, 122*a*, and 122*b* are branched from the gas refrigerant pipelines 21 and 121 and connected to the indoor heat exchangers 62*a*, 62*b*, 162*a*, and 162*b*.

The heating mode return branch pipelines 26 and 126 are branched from forward sides (parts before the refrigerant reaches to the liquid refrigerant branch pipelines) of the liquid refrigerant pipelines 23 and 123 for returning refrigerant heat exchanged at selected indoor units depending on operation conditions. The cooling mode return branch pipelines 25*a*, 25*b*, 125*a*, 125*b* are branched from the gas refrigerant branch pipelines 22*a*, 22*b*, 122*a* and 122*b*, for returning refrigerant heat exchanged at selected indoor units depending on operation conditions.

The return pipelines 27 and 127 join the cooling mode return branch pipelines 25*a*, 25*b*, 125*a*, 125*b*, and the heating mode return branch pipelines 26 and 126 into one, and connected to the outdoor unit pipelines. The return pipelines 27 and 127 are connected to the low pressure branch pipelines 8.

It is preferable that the gas refrigerant branch pipelines 22*a*, 22*b*, 122*a*, and 122*b*, and the liquid refrigerant branch pipelines 24*a*, 24*b*, 124*a* and 124*b* are arranged in parallel to each other, for putting into one pipe duct (not shown), that improves an efficiency of work and appearance. Moreover, if the gas refrigerant branch pipelines 22*a*, 22*b*, 122*a*, and 122*b*, and the liquid refrigerant branch pipelines 24*a*, 24*b*, 124*a* and 124*b* are put together in the pipe duct from the starting in fabrication, the efficiency of piping work is further improved.

In the meantime, the distributors B1 and B2 further include a valve part for controlling flow of the refrigerant flowing along the distributor pipelines for guiding the refrigerant only to selected indoor units depending on operation conditions.

In more detail, the valve part includes first and second expansion valves 31, 131, 32, and 132, and a plurality of control valves 33*a*, 33*b*, 34*a*, 34*b*, 35*a*, 35*b*, 133*a*, 133*b*, 134*a*, 134*b*, 135*a*, and 135*b*.

The first electronic expansion valves 31 and 131 are provided between the gas-liquid separators 10 and 100 and the heating mode return branch pipelines 26 and 126, for regulating opening according to operation conditions. The second electronic expansion valves 32 and 132 are provided to the heating mode return branch pipelines 26 and 126, for regulating opening according to operation conditions.

The control valves 33*a*, 33*b*, 34*a*, 34*b*, 35*a*, 35*b*, 133*a*, 133*b*, 134*a*, 134*b*, 135*a*, and 135*b* are provided to the gas refrigerant branch pipelines 22*a*, 22*b*, 122*a*, and 122*b*, the liquid refrigerant branch pipelines 24*a*, 24*b*, 124*a*, and 124*b*, and the cooling mode return branch pipelines 25*a*, 25*b*, 125*a*, and 125*b*. It is preferable that the control valves 33*a*, 33*b*, 34*a*, 34*b*, 35*a*, 35*b*, 133*a*, 133*b*, 134*a*, 134*b*, 135*a*, and 135*b* are two way valves each of which can be turned ON/OFF, selectively.

The cooling mode return branch pipelines 25*a*, 25*b*, 125*a*, and 125*b* are branched from the gas refrigerant branch pipelines 22*a*, 22*b*, 122*a*, and 122*b* between the indoor heat exchangers 62*a*, 62*b*, 162*a*, and 162*b* and the control valves 33*a*, 33*b*, 133*a*, and 133*b*.

The distributor pipeline may further include equalizing pipelines E connecting the distributors B1 and B2 for equal supply of refrigerant to the distributors B1 and B2. Because it is liable that the refrigerant supply is not equal when there are a plurality of distributors. Therefore, the equalizing pipelines E are provided for equal supply of the refrigerant to the distributors B1 and B2, to prevent accumulation or the refrigerant at one of the distributors B1 or B2, and improve an air conditioning efficiency.

It is preferable that the equalizing pipelines E includes a gas refrigerant equalizing pipeline EG, and a liquid refrigerant equalizing pipeline EL. The gas refrigerant equalizing pipeline EG supplies the gas refrigerant from the gas-liquid separators 10 and 100 to the distributors B1 and B2 equally, and the liquid refrigerant equalizing pipeline EL supplies the liquid refrigerant from the gas-liquid distributors 10 and 100 to the distributors B1 and B2. The liquid refrigerant equalizing pipeline EL connects the liquid refrigerant pipelines 23 and 123, and the gas refrigerant equalizing pipeline EG connects the gas refrigerant pipelines 21 and 121.

In the meantime, the liquid refrigerant equalizing pipeline EL for flow of high pressure liquid refrigerant has a diameter smaller than the gas refrigerant equalizing pipeline EG for preventing unbalance of refrigerant flow caused by a difference of specific volumes of the high pressure refrigerant ant the low pressure refrigerant.

Finally, with regard to the indoor units C1, C2, C3, and C4, the indoor heat exchangers 62*a*, 62*b*, 162*a*, and 162*b* are connected to the distributor pipelines. The indoor heat exchangers 62*a*, 62*b*, 162*a*, and 162*b* are connected to the gas refrigerant branch pipelines 22*a*, 22*b*, 122*a*, and 122*b* and the liquid refrigerant branch pipelines 24*a*, 24*b*, 124*a*, and 124*b* in the distributor pipelines, and the electronic expansion valves 61*a*, 61*b*, 161*a*, and 161*b* are provided to the liquid refrigerant branch pipelines 24*a*, 24*b*, 124*a*, and 124*b*.

Figure 2:
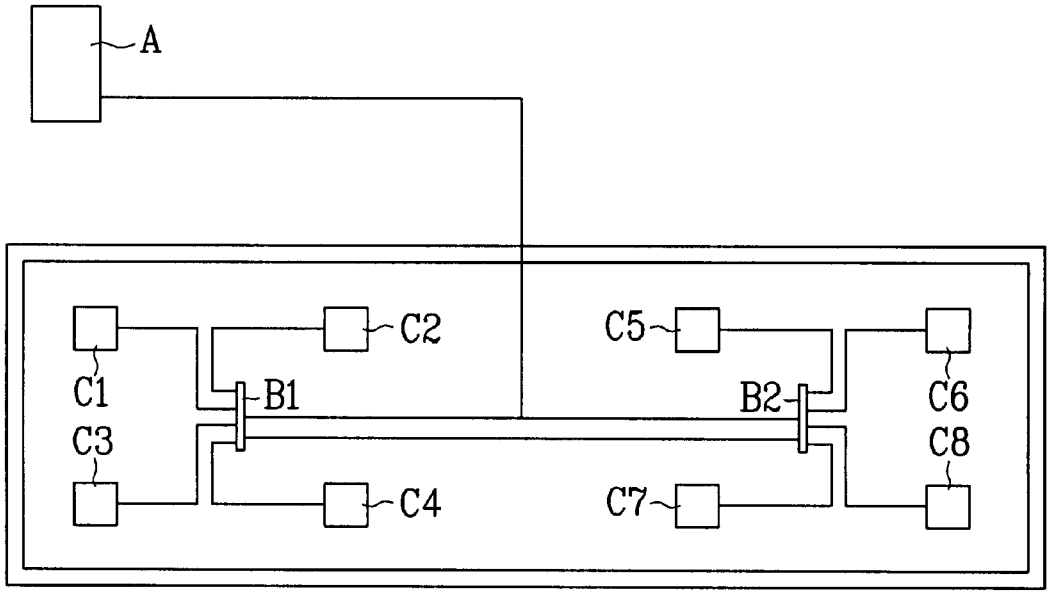
FIG. 2 illustrates a system showing key parts of a multi-type air conditioner in accordance with a preferred embodiment of the present invention, schematically.

The description up to now is based on an assumption that a number of the indoor units are four. However, as shown in FIG. 2, four distributors may be provided to each of the distributors B1 and B2, to includes eight indoor units C1, C2, C3, C4, C5, C6, C7, and C8, in total in the multi-type air conditioner.

The operation and refrigerant flow of the multi-type air conditioner of the present invention will be described with reference to FIGS. 3A~5B. It is assumed that three indoor units are in a cooling mode and one indoor unit is in a heating mode when the air conditioner of the present invention is in a major cooling mode in which the air conditioner mostly cools the rooms. Opposite to this, it is assumed that three indoor units are in a heating mode and one indoor unit is in a cooling mode when the air conditioner of the present invention is in a major heating mode in which the air conditioner mostly heats the rooms.

It is also assumed that the indoor units C1 and C2 connected to the distributor B1 are in a heating mode, and the indoor units C3 and C4 connected to the distributor B2 are in a cooling mode in a grouped operation of the multi-type air conditioner. In the grouped operation, the indoor units connected to one distributor are in the same mode. Of course, when the multi-type air conditioner only cools or heats, all of the indoor units are only cool or heat the rooms.

When the multi-type air conditioner of the present invention only cools the rooms, as shown in FIG. 3, the gas refrigerant from the compressor 1 is introduced into the outdoor heat exchanger 2 by the first four way valve 4*a*, and condensed therein.

Then, the refrigerant condensed in the outdoor heat exchanger 2 is introduced into the high pressure section HP by the second four way valves 4*b*. The refrigerant introduced into the high pressure section HP is introduced into the gas-liquid separators 10 and 100 along the high pressure branch pipelines 7.

The high pressure liquid refrigerant introduced into the gas-liquid separators 10 and 100 are introduced into the liquid refrigerant pipelines 23 and 123, passes through the first electronic expansion valves 31 and 131, which are opened fully, and branched to the liquid refrigerant branch pipelines 24*a*, 24*b*, 124*a*, and 124*b*.

A portion of refrigerant remained after the branching flows along the liquid refrigerant equalizing pipeline EG connected to the liquid refrigerant pipelines 23 and 123 back and forth, thereby distributing the refrigerant equally to the first and second distributors B1 and B2.

Thereafter, the liquid refrigerant expands through the electronic expansion valves 61*a*, 61*b*, 161*a*, and 161*b*, and evaporates through the heat exchangers 62*a*, 62*b*, 161*a*, and 162*b*, and cools the rooms. In this instance, the liquid refrigerant is turned into gas refrigerant as the refrigerant passes through the indoor heat exchangers 24*a*, 24*b*, 124*a*, and 124*b*.

The gas refrigerant passed through the indoor units 24*a*, 24*b*, 124*a*, 124*b* flows along the gas refrigerant branch pipelines 22, and 122. Then, since the control valves 33*a*, 133*a* are in closed position, the refrigerant is introduced into the return pipelines 27 and 127 through the cooling mode return branch pipelines 25*a*, 25*b*, 125*a*, and 125*b*. The refrigerant introduced into the return pipelines 27 and 127 are drawn into the compressor 1 through the second four way valve 4*b* and the first four way valve 4*a*.

Figure 3A:
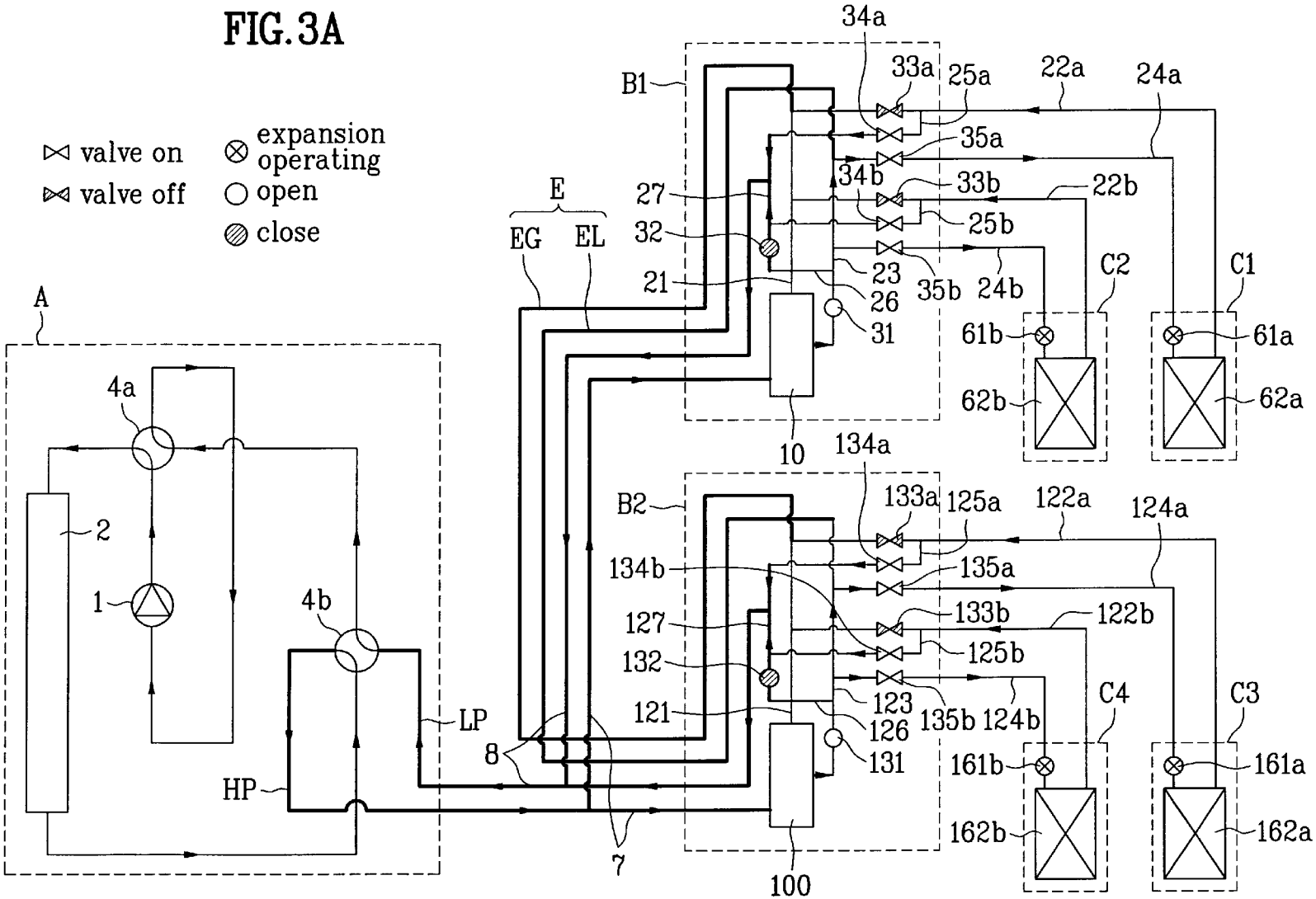
FIG. 3A illustrates a system showing an operation state of a multi-type air conditioner in accordance with a preferred embodiment of the present invention when the multi-type air conditioner carries out cooling only.
Figure 3B:
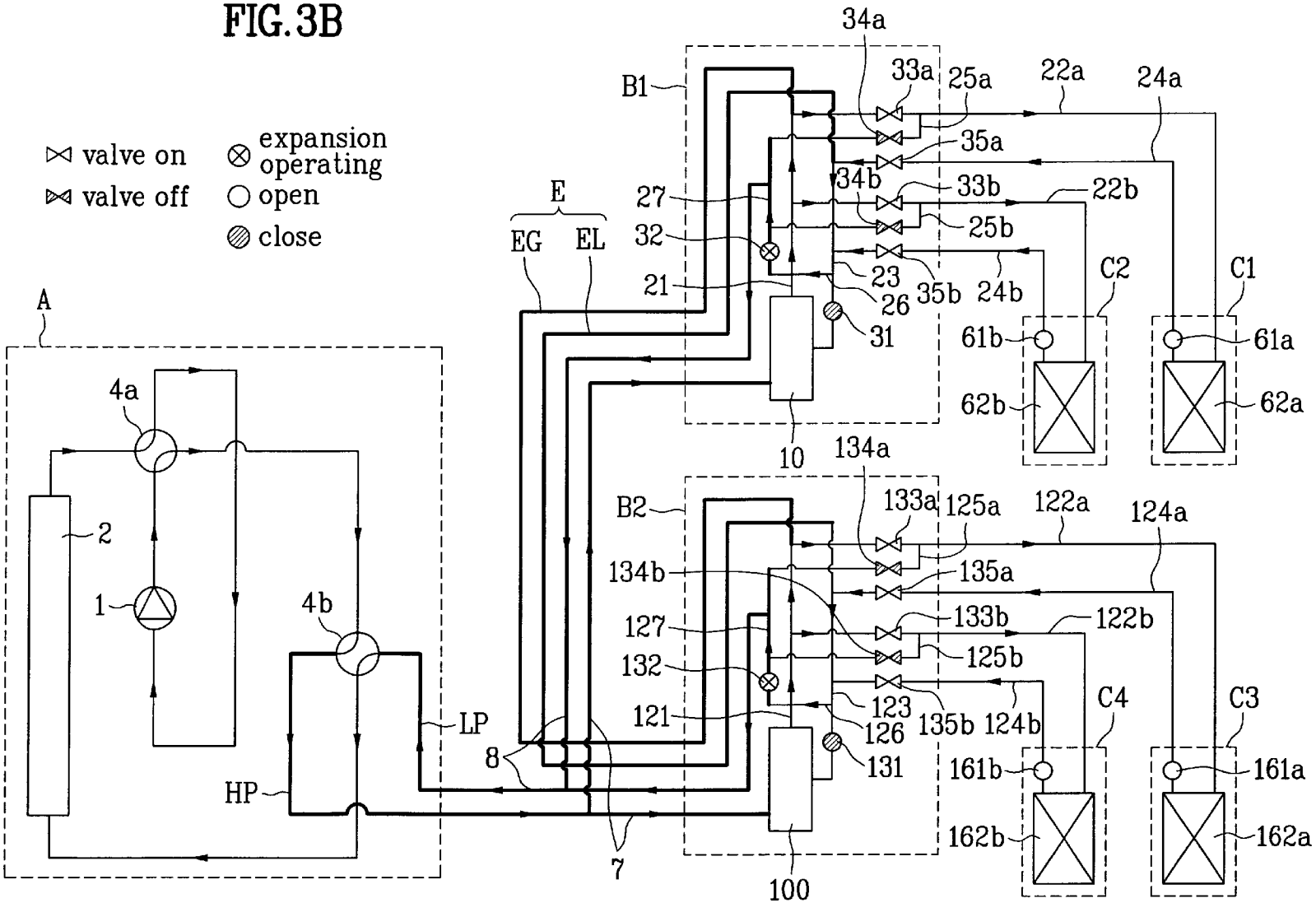
FIG. 3B illustrates a system showing an operation state of a multi-type air conditioner in accordance with a preferred embodiment of the present invention when the multi-type air conditioner carries out heating only.

Referring to FIG. 3B, when the multi-type air conditioner of the present invention only heats the rooms, the gas refrigerant from the compressor 1 is provided to the second four way valve 4*b* by the first four way valve 4*b*. Then, the gas refrigerant flows through the high pressure section HP by the second four way valve 4*b*, and introduced into the gas-liquid separators 10 and 100 through the high pressure branch pipelines 7. Thus, different from cooling, the gas refrigerant from the compressor 1 is introduced into the second four way valve 4*b* in a high pressure state without passing through the outdoor heat exchanger 2. It can be known that a refrigerant flow path to the outdoor unit differ as operation the first and second four way valves 4*a* and 4*b* are different.

The high pressure gas refrigerant introduced into the gas-liquid separators 10 and 100 flows into the gas refrigerant pipelines 21 and 121, and branched to the gas refrigerant branch pipelines 22*a*, 22*b*, 122*a*, and 122*b*. In this instance, a portion of the refrigerant remained after the branching flows along the gas refrigerant equalizing pipeline EG connected to the gas refrigerant equalizing pipeline EG back and forth, thereby distributing the refrigerant equally to the first and second distributors B1 and B2.

Thereafter, the gas refrigerant is condensed and heats the rooms as the gas refrigerant passes through the indoor heat exchangers 62, and 162. The gas refrigerant is turned into liquid refrigerant as the gas refrigerant passes through the indoor heat exchangers 62*a*, 62*b*, 162*a*, and 162*b*.

The gas refrigerant passed through the indoor heat exchangers 24*a*, 24*b*, 124*a*, and 124*b* flows through the electronic expansion valves 61*a*, 61*b*, 161*a*, and 161*b* in the indoor units, the liquid refrigerant branch pipelines 24*a*, 24*b*, 124*a*, and 124*b*, and the liquid refrigerant pipelines 23, and 123, in succession. Then, the refrigerant is introduced into the heating mode return branch pipelines 26 and 126 as the first electronic expansion valves 31 and 131 are in a closed position, and is expanded by the second electronic expansion valves 32 and 132. The expanded refrigerant flows to the second four way valve 4*b* through the return pipelines 27 and 127 and the low pressure branch pipeline 8.

Then, the refrigerant introduced into the second four way valve 4*b* is evaporated as the refrigerant passes through the outdoor heat exchanger 2, and introduced into the first four way valve 4*a*. Then, the refrigerant is drawn to the compressor 1 through the first four way valve 4*a*.

Figure 4A:
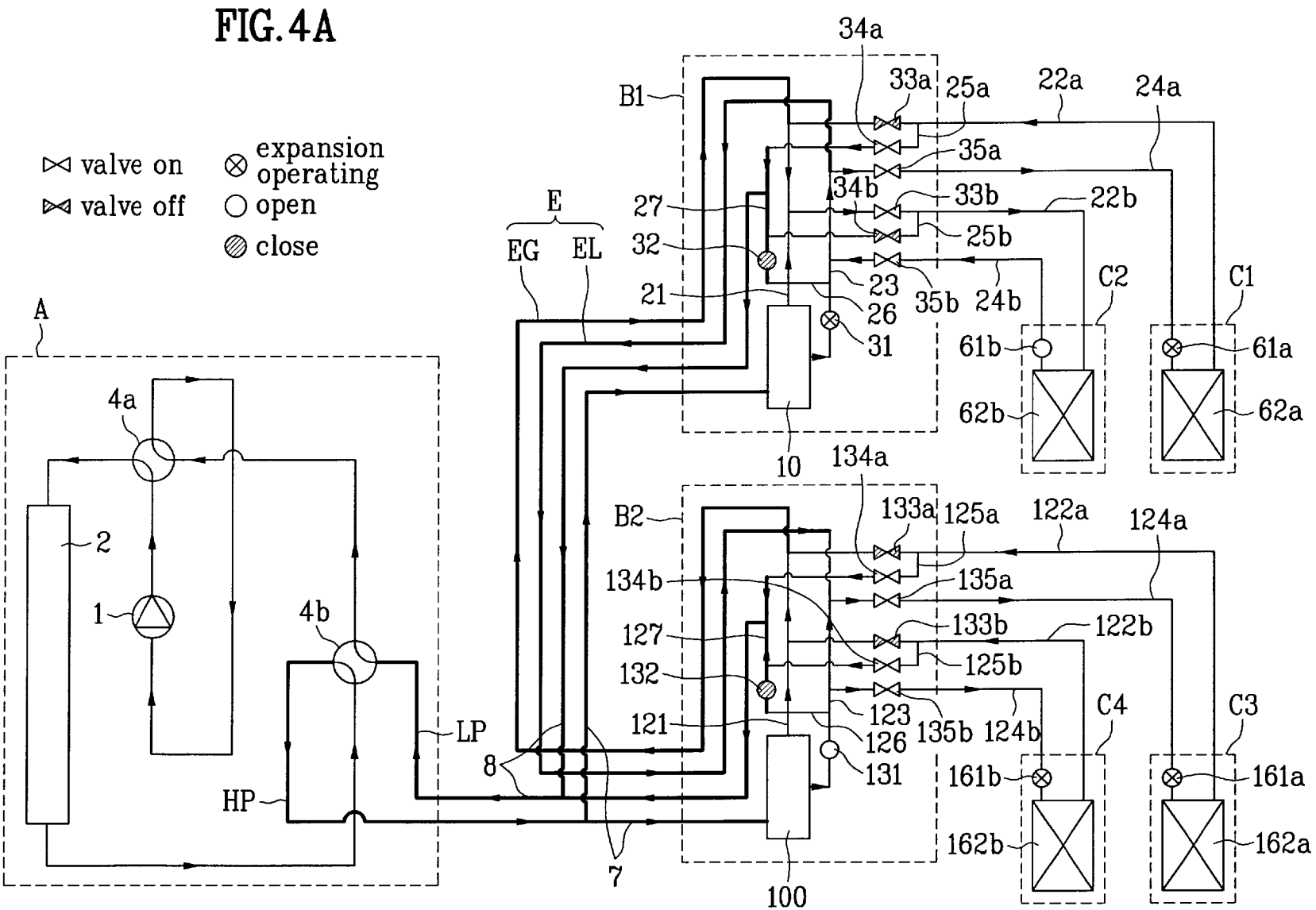
FIG. 4A illustrates a system showing an operation state of a multi-type air conditioner in accordance with a preferred embodiment of the present invention when the multi-type air conditioner is in a major cooling mode.

Referring to FIG. 4A, when the multi-type air conditioner of the present invention is operated in a major cooling mode, the gas refrigerant from the compressor is introduced into the outdoor heat exchanger 2 by the first four way valve, and a portion of the refrigerant is condensed. Therefore, the refrigerant passed through the outdoor heat exchanger 2 becomes two phased refrigerant having a gas refrigerant and liquid refrigerant mixed therewith.

Then, the two phased refrigerant is introduced into the gas-liquid separators 10 and 100 through the high pressure branch pipeline in the high pressure section HP by the second four way valve 4*b*.

The high pressure two phased refrigerant is separated into liquid refrigerant and gas refrigerant by the gas-liquid separators 10 and 100. The liquid refrigerant separated at the gas-liquid separators 10 and 100 is introduced into the liquid refrigerant pipelines 23 and 123, and branched to selected liquid refrigerant branch pipelines 24*a*, 124*a*, and 124*b*.

Then, the liquid refrigerant is expanded through the electronic expansion valves 61*a*, 161*a*, and 161*b*, and evaporated through the indoor heat exchanger 62*a*, 162*a*, 162*b*, and cools the rooms.

On the other hand, the gas refrigerant separated at the gas-liquid separators 10 and 100 is introduced into the gas refrigerant pipelines 21 and 121 in the distributors B1 and B2. The gas refrigerant introduced into the gas refrigerant pipeline 121 of the distributor B2 is introduced into the gas refrigerant pipeline of the distributor B1 through the gas refrigerant equalizing pipeline EL. Therefore, the gas refrigerant separated at the gas-liquid separators 10 and 100 is introduced into the gas refrigerant pipeline 21, entirely.

Then, the gas refrigerant is introduced into selected gas refrigerant branch pipelines 22*b* through the gas refrigerant pipeline 21, and heats rooms as the refrigerant passes through the indoor heat exchanger 62*b*. The refrigerant passed through the indoor heat exchanger joins with the liquid refrigerant pipelines 23 and 123 through the opened electronic expansion valve 61*b* of the indoor unit C2 and the liquid refrigerant branch pipeline 24*b*.

At the end, after the gas refrigerant separated at the gas-liquid separators 10 and 100 heats the rooms, the gas refrigerant also cools the rooms together with the liquid refrigerant separated at the gas-liquid separators 10 and 100.

The liquid refrigerant pipeline 23 of the distributor B1 and the liquid refrigerant pipeline 123 of the distributor B2 are connected to each other with the liquid equalizing pipeline EL. The gas refrigerant pipeline 21 of the distributor B1 and the gas refrigerant pipeline 121 of the distributor B2 are connected to each other with the gas equalizing pipeline EG. According to this, the gas and liquid refrigerant can flow between the distributors B1 and B2 freely, thereby preventing accumulation of the refrigerant on one of the distributors B1 and B2.

The liquid refrigerant is introduced only to selected liquid refrigerant branch pipelines 24*a*, 124*a*, 124*b* owing to a pressure difference. In more detail, it is controlled such that a pressure of the refrigerant from the liquid refrigerant branch pipeline 24*b* is higher than a pressure of the refrigerant introduced into the liquid refrigerant branch pipeline 24*a*. Therefore, the liquid refrigerant is introduced only to the selected liquid refrigerant branch pipelines 24*a*, 124*a*, 124*b*.

Then, the refrigerant evaporated as the refrigerant passes through the indoor heat exchangers 62*a*, 162*a*, and 162*b* moves through the gas refrigerant branch pipelines 22*a*, 122*a*, and 122*b* until the refrigerant is blocked at the control valves 33*a*, 133*a*, and 133*b* when the refrigerant is introduced into the cooling mode return branch pipelines 25*a*, 125*a*, and 125*b*. Then, the refrigerant is introduced into the compressor 1 through the second four way valve 4*b* and the first four way valve 4*a*.

Figure 4B:
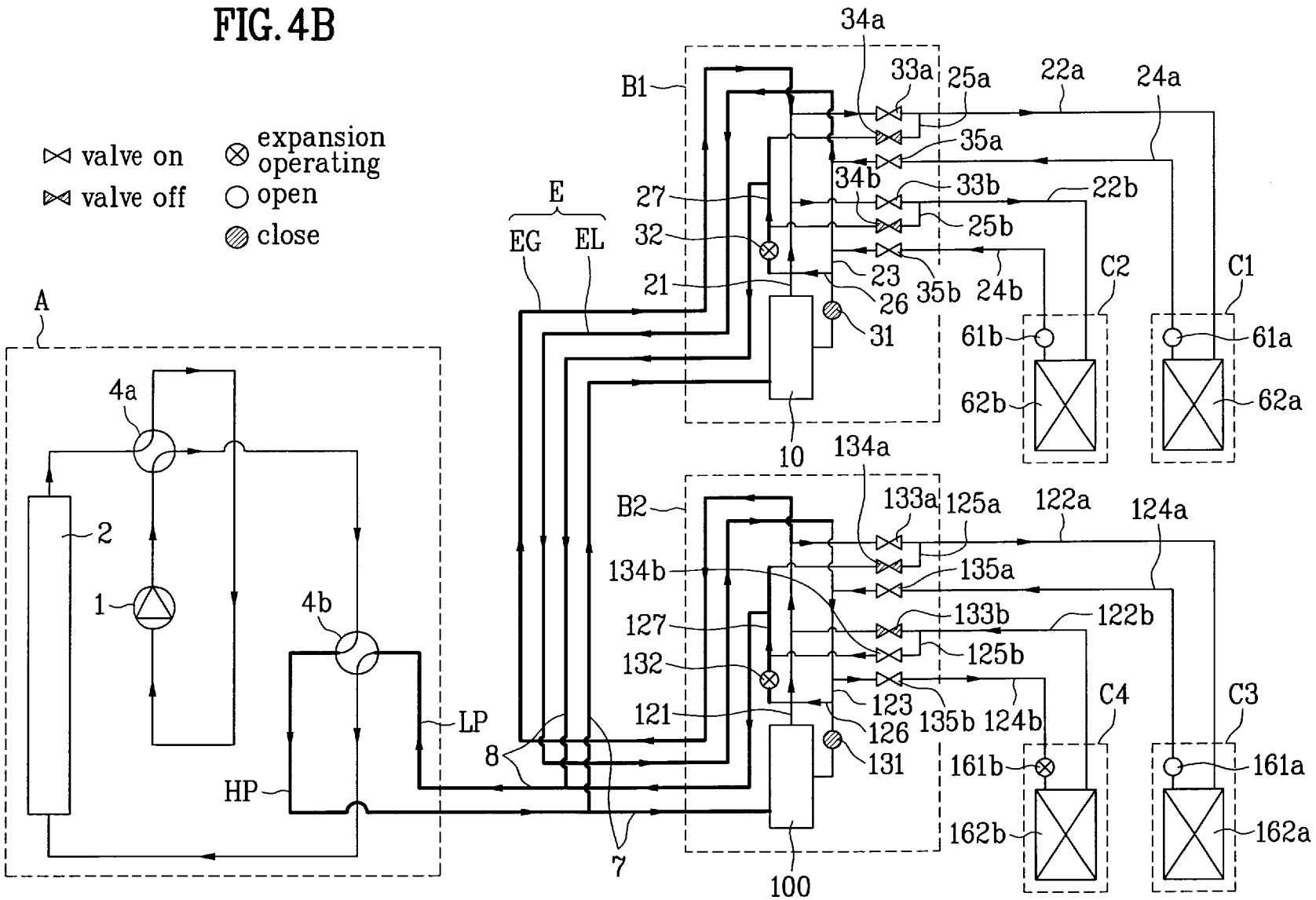
FIG. 4B illustrates a system showing an operation state of a multi-type air conditioner in accordance with a preferred embodiment of the present invention when the multi-type air conditioner is in a major heating mode.

Referring to FIG. 4B, when the multi-type air conditioner of the present invention is operated in a major cooling mode, the gas refrigerant from the compressor 1 is provided to the second four way valve 4*b* in a high pressure state by the first four way valve 4*a* without passing through the outdoor heat exchanger 2.

Then, the gas refrigerant provided to the second four way valve 4*b* is introduced into the gas-liquid refrigerant 10 and 100 through the high pressure branch pipe 7 in the high pressure section HP by the second four way valve 4*b*.

The high pressure gas refrigerant introduced into the gas-liquid separators 10 and 100 is introduced into the gas refrigerant pipelines 21 and 121, and branched to selected gas refrigerant branch pipelines 22*a*, 22*b*, and 122*a*. Then, the refrigerant is condensed as the refrigerant passes through the indoor heat exchangers 62*a*, 62*b*, and 162*a*, to heat the rooms.

Then, the condensed refrigerant is introduced into the liquid refrigerant branch pipelines 24*a*, 24*b*, and 124*a* through the opened electronic expansion valves 61*a*, 61*b*, and 161*a* in the indoor units C1, C2, and C3. In this instance, a portion of the refrigerant is introduced into the liquid refrigerant pipelines 23 and 123, and the heating mode return branch pipelines 26, and 126, expands at the second electronic valves 32 and 132, and introduced into the return pipelines 27 and 127, and the low pressure branch pipeline 8 in the low pressure section LP.

At the same time with this, a remained portion of the condensed refrigerant is introduced into selected liquid refrigerant branch pipeline 124*b*, expands through the electronic expansion valves 161*b* of the indoor unit C4, and evaporated as the refrigerant passes through the indoor unit heat exchanger 162*b*, to cool down rooms which require cooling. The refrigerant passed through the heat exchanger 162*b* moves through the gas refrigerant branch pipeline 122*b* until blocked by the control valve 133*b*, when the refrigerant is introduced into the low pressure branch pipe 8 through the return branch pipe 125*b*. Thereafter, the refrigerant is introduced into the low pressure branch pipelines 8 through the return pipeline 127.

The liquid refrigerant pipeline 23 of the distributor B1 and the liquid refrigerant pipeline 123 of the distributor B2 are connected to each other with the liquid equalizing pipeline EL, and the gas refrigerant pipeline 21 of the distributor B1 and the gas refrigerant pipeline 121 of the distributor B2 are connected to each other with the gas equalizing pipeline EG. According to this, the gas and liquid refrigerant can flow between the distributors B1 and B2 freely, thereby preventing accumulation of the refrigerant on one of the distributors B1 and B2.

The condensed refrigerant is introduced, not to at least one of the liquid refrigerant branch pipelines 24*a*, 24*b*, and 124*a* on a side that requires heating, but to the liquid refrigerant branch pipeline 124*b* on a side that requires cooling, owing to a pressure difference. That is, a pressure of the refrigerant from the indoor units C1, C2, and C3 that heat the rooms to the liquid refrigerant branch pipelines 24*a*, 24*b*, and 124*a* is higher than a pressure of the refrigerant flowing to the indoor unit that cools the room through the liquid refrigerant branch pipeline 124*b*.

On the other hand, the refrigerant introduced into the low pressure branch pipeline 8 is provided to the outdoor heat exchanger 2 by the second four way valve 4*b*. Then, the refrigerant is evaporated at the outdoor heat exchanger, and drawn to the compressor 1 through the first four way valve 4*a*.

Finally, the grouped operation of the multi-type air conditioner of the present invention will be discussed. First, a case of the grouped operation of the multi-type air conditioner when the first and second four way valves 4*a*, and 4*b* of the outdoor unit 'A' are in operation the same with the foregoing cooling or major cooling mode.

Referring to FIG. 5A, the gas refrigerant from the compressor 1 is introduced into the outdoor heat exchanger 2 by the first four way valve 4*a*, and a portion of the refrigerant is condensed to become two phased refrigerant. Then, the two phased refrigerant is introduced into the gas-liquid separators 10 and 100 through the high pressure branch pipeline 7 in the high pressure section HP by the second four way valve 4*b*.

The high pressure two phased refrigerant introduced into the gas-liquid separator 10 and 100 is separated into liquid refrigerant and gas refrigerant. At first, the liquid refrigerant separated at the gas-liquid separator 100 in the distributor B2 is introduced into the liquid refrigerant pipeline 123 through the opened first electronic expansion valve 31, and branched to the liquid refrigerant branch pipelines 124*a*, and 124*b*. Thereafter, the branched liquid refrigerant expands through the electronic expansion valves 161*a* and 161*b* in the indoor units, and evaporates through the indoor heat exchangers 162*a* and 162*b*, and cools the rooms. The refrigerant passed through the indoor heat exchangers 162*a* and 162*b* moves through the gas refrigerant branch pipelines 122*a*, and 122*b* until blocked by the control valves 133*a* and 133*b* when the refrigerant is introduced into the low pressure branch pipelines 8 through the return branch pipelines 125*a* and 125*b* and the return pipelines 127 in succession.

The liquid refrigerant separated at the gas-liquid separator 10 in the distributor B1 is introduced into the liquid refrigerant pipeline 23, expands through the first electronic expansion valve 31, and introduced into the heating mode return branch pipeline 26. Then, the refrigerant expands at the second electronic expansion valve 32, and introduced into the low pressure branch pipelines 8 through the return pipeline 27.

In the meantime, the gas refrigerant separated at the gas-liquid separators 10 and 100 is introduced into the gas refrigerant pipelines 21 and 121. In this instance, the gas refrigerant separated at the gas-liquid separator 100 of the distributor B2 is blocked by the control valves 133*a* and 133*b* when the refrigerant flows to the gas refrigerant pipeline 21 of the distributor B1 through the gas refrigerant equalizing pipeline EL, and joins with the gas refrigerant separated at the gas-liquid separator 10 of the distributor B1.

Thereafter, the gas refrigerant is introduced into selected gas refrigerant branch pipelines 22*a* and 22*b*, and passes through the indoor heat exchangers 62*a* and 62*b*, to heat rooms which require heating. The refrigerant passed through the indoor heat exchangers 62*a* and 62*b* passes through opened electronic expansion valves 61*a* and 61*b* of the indoor units C1 and C2, liquid refrigerant branch pipelines 24*a* and 24*b*,and liquid refrigerant pipeline 23 in succession. In this instance, a portion of the refrigerant passes through the heating mode return branch pipeline 26 together with liquid refrigerant separated at the gas-liquid separator 10 of the distributor B1, expands through the second electronic expansion valve 32, and introduced into the low pressure branch pipeline 8 through the return pipeline 27.

Rest of the refrigerant is introduced into the liquid refrigerant pipeline 123 of the distributor B2 through the liquid refrigerant equalizing pipeline EL, and evaporated through the indoor heat exchangers 162*a* and 162*b*, to cool the rooms. Thereafter, the refrigerant is introduced into the low pressure branch pipelines 8 through the gas refrigerant branch pipelines 122*a*, and 122*b*, cooling mode return branch pipelines 125*a* and 125*b*, and the return pipeline 127 in succession.

The liquid refrigerant pipeline 23 of the distributor B1 and the liquid refrigerant pipeline 123 of the distributor B2 are connected with the liquid refrigerant equalizing pipeline EL. The gas refrigerant pipeline 21 of the distributor B1 and the liquid refrigerant pipeline 121 of the distributor B2 are connected with the liquid refrigerant equalizing pipeline EG. Therefore, since the refrigerant flows back and forth between the distributor B1 and the distributor B2, no refrigerant is accumulated on one of the distributors B1 and B2.

Thus, the liquid refrigerant is introduced into the liquid refrigerant branch pipelines 124*a* and 124*b* of the distributor B1. This is because the liquid refrigerant from the liquid refrigerant branch pipelines 24*a* and 24*b* of the distributor B1 has a pressure higher than a pressure of the refrigerant flowing thereto.

In the meantime, the refrigerant introduced into the low pressure branch pipeline 8 is drawn to the compressor 1 through the second four way valve 4*b* and the first four way valve 4*a*.

Next, a case of the grouped operation of the multi-type air conditioner when the first and second four way valves 4*a*, and 4*b* of the outdoor unit 'A' are in operation the same with the foregoing heating or major heating mode.

Referring to FIG. 5B, the gas refrigerant from the compressor 1 is provided to the second four way valve 4*b* in a high pressure state by the first four way valve 4*a* without passed through the outdoor heat exchanger 2. Then, the gas refrigerant is introduced into the gas-liquid separators 10 and 100 through the high pressure branch pipeline 7 in the high pressure section HP by the second four way valve 4*b*.

Then, the high pressure gas refrigerant is introduced from the gas-liquid separators 10 and 100 to the gas refrigerant pipelines 21 and 121. In this instance, the gas refrigerant separated at the gas-liquid separator 100 of the distributor B2 is blocked by the control valves 133*a* and 133*b* so as to be introduced into the gas refrigerant pipeline 21 of the distributor B1 through the gas refrigerant equalizing pipeline EL, and join with the gas refrigerant of the distributor B1. Then, the refrigerant is branched to the gas refrigerant branch pipelines 22*a* and 22*b*, and passes through the indoor heat exchangers 62*a* and 62*b*, to heat the rooms while the refrigerant is condensed.

The condensed refrigerant passes through opened electronic expansion valves 61*a* and 61*b*, the liquid refrigerant branch pipelines 24*a* and 24*b*, and the liquid refrigerant pipeline 23. In this instance, a portion of the condensed refrigerant passes through the return branch pipeline 26, expands at the second electronic expansion valve 32, and introduced into the low pressure branch pipeline 8 through the return pipelines 27.

On the other hand, rest of the condensed refrigerant is introduced into the liquid refrigerant branch pipelines 124*a* and 124*b* of the distributor B2 through the liquid refrigerant equalizing pipeline EL. Thereafter, the refrigerant expands through the electronic expansion valves 161*a* and 161*b* of the indoor units C3 and C4.

The expanded refrigerant is evaporated through the indoor heat exchangers 161*a* and 162*b*, to cool the rooms that require cooling. Then, the refrigerant moves through the gas refrigerant branch pipelines 122*a* and 122*b* until blocked by the control valves 133*a* and 133*b* when the refrigerant is introduced into the low pressure branch pipeline 8 through the cooling mode return branch pipelines 125*a* and 125*b* and the return pipeline 127.

Then, the refrigerant is introduced into the outdoor heat exchanger 2 through the low pressure section LP by the second four way valve 4*b*. Thereafter, the refrigerant is drawn to the compressor 1 through the first four way valve 4*a*.

As has been described, the multi-type air conditioner of the present invention has the following advantages.

The multi-type air conditioner of the present invention permits to carry out an optimal operation proper to individual room environment. That is, a building with a plurality of rooms, inclusive of a room of which temperature varies with position in a building or a time of a day, or a computer room that requires cooling not only during summer, but also during winter, can be air conditioned optimally by major cooling/heating mode operation or grouped operation as required.

Second, the provision of at least two distributors increases freedom of indoor unit installation. Therefore, even if a distance between the indoor units is great, the installation is easy.

Moreover, the provision of at least two distributors reduces a pipeline length. If many pipelines are lead from one distributor to the indoor units, the pipeline can not but be long if the indoor unit is far from the distributor. However, by providing separate distributor, which enables to lead the pipeline from the distributor to the indoor unit, the pipeline length can be reduced.

Third, the provision of the liquid refrigerant equalizing pipeline and the gas refrigerant equalizing pipeline permits equal supply of the refrigerant to the distributors, thereby preventing accumulation of a particular state of refrigerant on one of the distributors, and improving an air conditioning efficiency.

Fourth, the parallel running of the gas refrigerant branch pipelines and the liquid refrigerant branch pipelines, which connect the distributors and the indoor units permits easy piping work, and to provide good outer appearance as a number of pipelines can be reduced if one duct is used.

Fifth, the simple piping structure of the outdoor unit reduces a pipe loss, which improves efficiency of the air conditioner, and simplifies a fabrication process to reduce a production cost.

Sixth, the smaller diameter of the high pressure section than the low pressure section prevents non-uniform flow rates between low pressure refrigerant with great specific volume and high pressure refrigerant with small specific volume in advance.

Seventh, the use of two way valves instead of three or four way valves in the distributors reduces production cost.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-type air conditioner comprising:

an outdoor unit installed to an outside of a room, including a compressor and a outdoor heat exchanger, outdoor pipelines connected to the compressor and the outdoor heat exchanger for forming flow paths, and a plurality of outdoor valves mounted on the outdoor pipelines for controlling refrigerant flow;

a plurality of indoor units installed in rooms respectively each including an indoor heat exchanger and an electronic expansion valve; and a plurality of distributors each including a gas-liquid separator for separating refrigerant from the outdoor unit into gas refrigerant and liquid refrigerant, and distributor pipelines for guiding the gas or liquid refrigerant separated at the gas-liquid separator to the indoor units, and guiding the refrigerant passed through the indoor unit to the outdoor unit again.

2. The multi-type air conditioner as claimed in claim 1, wherein the outdoor pipelines includes;

a pipeline connecting an outlet of the compressor and an inlet of the gas-liquid separator, to form a refrigerant flow passage from the compressor to the gas-liquid separator; and a pipeline connecting a distributor pipeline and the inlet of the compressor to form a refrigerant flow passage from the distributor to the compressor.

3. The multi-type air conditioner as claimed in claim 2, wherein the outdoor valves include;

a first four way valve mounted on an outlet side of the compressor for making the outdoor pipelines in communication with each other selectively depending on operation conditions, to fix a flow path of the refrigerant to/from the compressor, and a second four way valve mounted on a gas-liquid separator side to be operative in correspondence to the first four way valve, for making the outdoor pipelines in communication with each other selectively depending on operation conditions, to fix a flow path of the refrigerant to the gas-liquid separator or from the distributor pipeline.

4. The multi-type air conditioner as claimed in claim 3, wherein the outdoor pipeline connected between the second four way valve and the gas-liquid separator is a high pressure section only a high pressure state of refrigerant flows therethrough, and the outdoor pipeline connected between the distributor pipeline and the second four way valve is a low pressure section only a low pressure state of refrigerant flows therethrough.

5. The multi-type air conditioner as claimed in claim 4, wherein the high pressure section includes high pressure branch pipelines branched to the gas-liquid separators, and the low pressure section includes low pressure branch pipelines branched to the distributor pipelines of the distributors.

6. The multi-type air conditioner as claimed in claim 4, wherein the high pressure section has a pipe diameter smaller than the low pressure section for prevention of non-uniform flow rates caused by a specific volume difference between high pressure refrigerant and low pressure refrigerant.

7. The multi-type air conditioner as claimed in claim 1, wherein the distributor pipelines includes;

a liquid refrigerant pipeline for guiding liquid refrigerant separated at the gas-liquid separators, a liquid refrigerant branch pipeline branched from the liquid refrigerant pipeline to the electronic expansion valves in the indoor units, a gas refrigerant pipeline for guiding gas refrigerant separated at the gas-liquid separators, a gas refrigerant branch pipeline branched from the gas refrigerant pipeline to the indoor heat exchangers in the indoor unit, and a heating mode return branch pipeline branched from a fore end of the liquid refrigerant pipeline for returning refrigerant heat exchanged in selected indoor units depending on operation conditions, a cooling mode return branch pipeline branched from each of the gas refrigerant branch pipelines for returning refrigerant heat exchanged at selected indoor units depending on operation conditions, and a return pipeline for joining the heating mode return branch pipeline and the cooling mode return branch pipeline into one pipeline and connected to the indoor unit pipelines.

8. The multi-type air conditioner as claimed in claim 7, wherein the gas refrigerant pipeline and the liquid refrigerant pipeline are arranged in parallel for an efficiency of piping.

9. The multi-type air conditioner as claimed in claim 7, wherein the outdoor pipelines includes;

a pipeline connecting an outlet of the compressor and an inlet of the gas-liquid separator, to form a refrigerant flow passage from the compressor to the gas-liquid separator; and a pipeline connecting the return pipeline and the inlet of the compressor to form a refrigerant flow passage from the distributor to the compressor.

10. The multi-type air conditioner as claimed in claim 9, wherein the outdoor valves include;

a first four way valve mounted on an outlet side of the compressor for making the outdoor pipelines in communication with each other selectively, to fix a flow path of the refrigerant to/from the compressor, and a second four way valve mounted on a gas-liquid separator side to be operative in correspondence to the first four way valve, for making the outdoor pipelines in communication with each other selectively, to fix a flow path of the refrigerant to/from the return pipeline.

11. The multi-type air conditioner as claimed in claim 10, wherein the outdoor pipeline connected between the second four way valve and the gas-liquid separator is a high pressure section only a high pressure state of refrigerant flows therethrough, and the outdoor pipeline connected between the distributor pipeline and the second four way valve is a low pressure section only a low pressure state of refrigerant flows therethrough.

12. The multi-type air conditioner as claimed in claim 11, wherein the high pressure section includes high pressure branch pipelines branched to the gas-liquid separators, and the low pressure section includes low pressure branch pipelines branched to the return pipelines of the distributors.

13. The multi-type air conditioner as claimed in claim 11, wherein the high pressure section has a pipe diameter smaller than the low pressure section for prevention of non-uniform flow rates caused by a specific volume difference between high pressure refrigerant and low pressure refrigerant.

14. The multi-type air conditioner as claimed in claim 7, wherein the distributor includes a valve part for controlling refrigerant flow in the distributor pipelines.

15. The multi-type air conditioner as claimed in claim 14, wherein the valve part includes;

a first electronic expansion valve mounted between the gas-liquid separator and the heating mode return branch pipeline for controlling an opening thereof depending on an operation condition, a second electronic expansion valve mounted on the heating mode return branch pipeline for controlling an opening thereof depending on an operation condition, and a plurality of control valves mounted on the gas refrigerant branch pipelines, liquid refrigerant branch pipelines, and cooling mode return branch pipeline.

16. The multi-type air conditioner as claimed in claim 15, wherein the control valve is two way valve turned on/off selectively depending on operation condition.

17. The multi-type air conditioner as claimed in claim 7, wherein the distributor pipeline further includes an equalizing pipeline part connected between the distributors for equal supply of refrigerant to the distributors.

18. The multi-type air conditioner as claimed in claim 17, wherein the equalizing pipeline part includes;

a gas refrigerant equalizing pipeline for equal supply of gas refrigerant introduced into the gas-liquid separators to the distributors, and liquid refrigerant equalizing pipeline for equal supply of liquid refrigerant introduced into the gas-liquid separators to the distributors.

19. The multi-type air conditioner as claimed in claim 18, wherein the gas refrigerant equalizing pipeline is connected to the gas refrigerant pipeline of the distributors, and the liquid refrigerant equalizing pipeline is connected to the liquid refrigerant pipeline of the distributors.

20. The multi-type air conditioner as claimed in claim 18, wherein the liquid refrigerant equalizing pipeline has a pipe diameter smaller than the gas refrigerant equalizing pipeline for prevention of non-uniform flow rates caused by a specific volume difference between high pressure refrigerant and low pressure refrigerant.

* * * * *